United States Patent [19]

Muench et al.

[11] Patent Number: 4,625,196

[45] Date of Patent: Nov. 25, 1986

[54] MODULAR UNDER OIL EXPULSION FUSE CARTRIDGE ASSEMBLY

[75] Inventors: Frank J. Muench, Waukesha; Gordon T. Borck, Cudahy, both of Wis.

[73] Assignee: RTE Corporation, Waukesha, Wis.

[21] Appl. No.: 748,265

[22] Filed: Jun. 24, 1985

[51] Int. Cl.[4] ..... H01H 85/14

[52] U.S. Cl. ..... 337/204; 337/217; 337/249; 337/250

[58] Field of Search ..... 337/204, 203, 217, 249, 337/250, 277–282

[56] References Cited

U.S. PATENT DOCUMENTS 4,205,295 5/1980 Mahieu ..... 337/204

4,220,941 9/1980 Mahieu et al. ..... 337/249

*Primary Examiner*—Harold Broome

[57] ABSTRACT

A modular under oil expulsion fuse cartridge assembly includes a tubular housing of non-electrical conductive material, an electrically conductive contact removably threadedly mounted on each end of the housing, and a replaceable fuse assembly removably slidably received within the tubular housing. The fuse assembly includes a fuse support tube and a fuse link supported within the tube electrically connected to each of the end contacts. The end contacts are designed with ramps or tapered ends to prevent arcing along the insulating surface of the fuse housing, and are located on the outside housing surface of the device away from the operating or arcing region of the assembly to provide a maximum strike distance between the end contacts. At least one of the electrical connections of the fuse link includes a plurality of deformable fingers movable between a first position which permits the fuse assembly to be slidably received within the housing, and a second position in which the fingers are spread outwardly by a clamping nut into engagement with an end contact.

10 Claims, 4 Drawing Figures

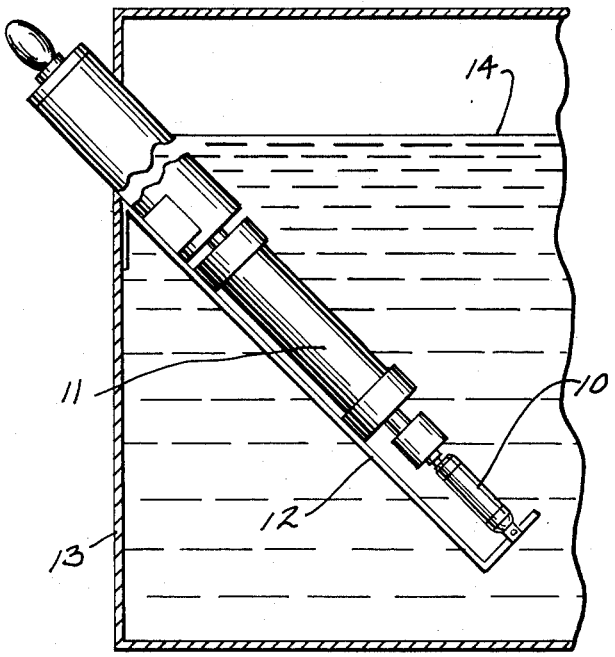
FIG. 1
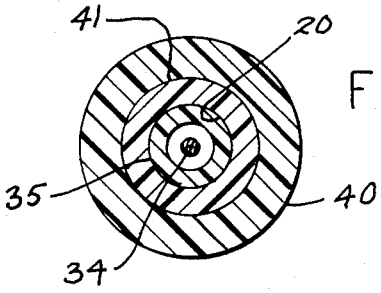
FIG. 3
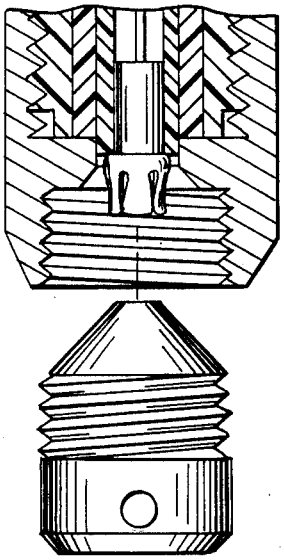
FIG. 4
FIG. 2
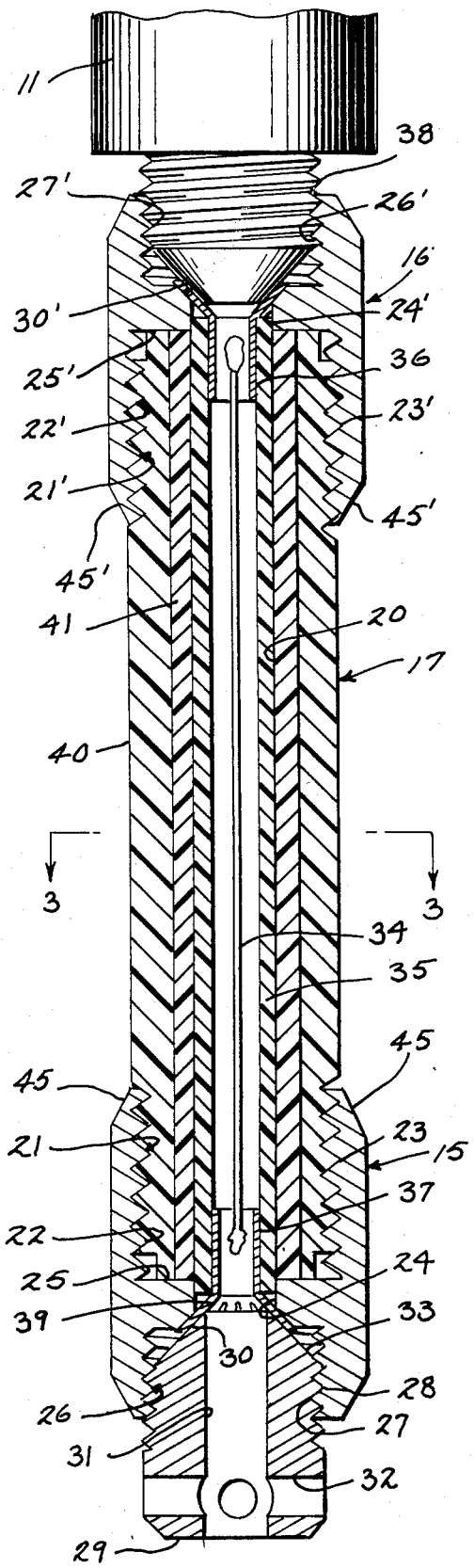

MODULAR UNDER OIL EXPULSION FUSE CARTRIDGE ASSEMBLY

BACKGROUND OF THE INVENTION

The present invention relates to fuses, and more particularly to a modular design for an under oil expulsion fuse cartridge.

Under oil expulsion fuses are generally used in high voltage systems to protect the electrical devices from fault currents. The expulsion fuse can be used by itself or in tandem with back up current limiting fuses since it can be used to provide current interruption under low fault conditions without operation of the more costly limiting fuse.

State of the art expulsion fuse cartridges are typically manufactured by assemblying two brass end contacts such that their projecting annular lips surround opposite ends of a molded nylon sleeve, winding a glass filament epoxy strengthening layer over the nylon sleeve and projecting lips, and then coating the epoxy layer with an arc extinguishing material such as polyester until the outer surface of the polyester is flush with the outer surface of the brass end contacts.

One problem with such an assembly is that the interface between the molded nylon sleeve and the glass epoxy layer may be a problem area if there is insufficient bond between these two materials. If not bonded properly, or if the molded sleeve contracts away from the glass layer, the interface area may produce a site for corona and possible flashover between the end contacts. Another problem with such an assembly is that when the cartridge is inserted or removed from a holder assembly the holder assembly contacts are dragged across the end contacts of the cartridge and deposit small metal and/or carbon particles on the polyester layer of the housing. This build-up of particles may cause arcing and possible flashover between the end contacts during operation with the resultant arc heat burning or carbonizing the housing thus reducing the electrical dielectric efficiency of the device.

SUMMARY OF THE INVENTION

An under oil expulsion fuse cartridge assembly of a modular type design with individual parts assembled together forming an interrupting device capable of providing electrical isolation following its operation.

The design includes a cartridge including a tubular housing of non-electrical conductive material having a bore extending longitudinally therethrough, an electrically conductive contact removably mounted on each end of the housing, and a replaceable fuse assembly removably received within the bore of the housing. The fuse assembly includes a fuse support tube and a fuse link supported within the tube electrically connected to each of the end contacts.

The end contacts are removably threadedly mounted on each end of the housing, and have a diameter greater than the diameter of the housing. Ramp means extending between the housing and the end contacts prevent the contacts of a holder assembly from engaging the cartridge housing when inserting or removing the cartridge from a holder. This prevents the possibility of metal or carbon particles being deposited on the outer surface of the housing and thus prevents arcing or flashover along this surface. This also prevents arc heat from burning and carbonizing the outer surface of the fuse cartridge. Preferably, the ramp means is integral with the end contacts which are designed with tapered ends having an inclination of between about 20° to about 45°. The tapered ends ease insertion and removal of the device by an easing the spring-loaded holder contacts out of the way during insertion and removal.

The end contacts are located on the outside housing surface of the device away from the operating or arcing region of the assembly. This provides for a maximum possible strike distance between the end contacts since the end contacts do not incorporate projectng annular lips communicating with an interface between the sleeve and epoxy layer. The device is thus designed to provide a maximum strike distance between the end contacts to give a superior dielectric strength which will enable a higher interrupting capability in comparison to other prior art devices. In order to accomplish this, each end contact includes a cylindrical body of electrically conductive material having a longitudinal opening extending therethrough which includes a first portion having internal threads for threadedly engaging external threads on the end of the cartridge housing, a second portion of reduced diameter that engages the electrical connection of the fuse link, and a third portion having a diameter greater than the second portion. The first and second portions define an abutment surface therebetween which engages the end of the housing when the end contact is threaded thereon and defines the strike distance between the end contacts.

In another aspect of the invention, at least one of the electrical connections of the fuse link includes a plurality of deformable fingers movable between a first position wherein the fingers extend substantially coaxially from the fuse support tube so that the fuse assembly may be slidably received with the bore of the housing, and a second deformed position extending in a direction transverse to the axis of the fuse support tube wherein the fingers are in electrical contact with an end contact. Clamping means receivable within the third portion of the end contact opening move the fingers from their first position to their second position. Preferably, this clamping means comprises a clamping nut threadedly engageable within the third portion of the opening and includes a cone shaped inner end so that as the nut is turned into the third portion the cone shaped inner end engages and spreads the fingers into engagement with the end contact.

The present invention thus provides a modular expulsion fuse cartridge design which provides easy assembly and disassembly. The design also eliminates possible arcing along the outer surface of the cartridge housing and provides for a maximum possible strike distance between the end contacts.

BRIEF DESCRIPTION OF THE DRAWINGS

The drawing illustrates the best mode presently contemplated of carrying out the invention.

In the drawings:

FIG. 1 is a side view in elevation with parts broken away illustrating a holder incorporating an expulsion fuse in accordance with the principles of the present invention;

FIG. 2 is a cross sectional side view in elevation illustrating an expulsion fuse in accordance with the principles of the present invention;

FIG. 3 is a cross sectional view taken along the plane of the line 3—3 in FIG. 2;

FIG. 4 is a detailed view illustrating a clamping nut deforming the fingers of an electrical connection for the fuse link.

DESCRIPTION OF THE PREFERRED EMBODIMENT

An expulsion fuse 10 may be used alone, or in tandem with a current limiting fuse 11, as illustrated in FIGS. 1 and 2. In the latter case, fuses 10 and 11 are in turn mounted on a support fixture 12 to hold their positions as required for proper operation. As shown in FIG. 1, the combined fuses 10 and 11 as well as mounting fixture 12 are generally installed in an enclosure 13 filled with an insulating fluid 14 such as oil to insulate and cool the enclosed electrical apparatus. As an alternative to fixture 12, fuse 10 may be held by a bayonet type fixture (not shown) of conventional construction.

Expulsion fuse 10 includes a pair of contacts 15 and 16 threadedly secured to the opposite ends of an insulating tubular housing 17. Each end contact 15 and 16 includes a cylindrical body having an outer diameter greater than the outer diameter of housing 17.

The inner ends of end contacts 15 and 16 are tapered and form annular ramps 45 and 45' respectively. When fuse 10 is utilized in the above-mentioned bayonet type fixture, ramps 45 and 45' prevent the contacts of a holder assembly from engaging the cartridge housing 17 when inserting or removing the cartridge from the holder. This prevents the possibility of metal or carbon particles being deposited on the outer surface of housing 17 and thus prevents arcing or flashover along this surface. This also prevents arc heat from burning and carbonizing the outer surface of the fuse cartridge. Ramps 45 and 45' are integral with end contacts 15 and 16, and are designed with a taper having an inclination of between about 20° to about 45°. The tapered ends or ramps 45 and 45' ease insertion and removal of the device by an easing of the spring-loaded holder contacts out of the way during insertion and removal. End contacts 15 and 16 are preferably composed of brass and include a smooth outer surface which serves as a sliding surface upon which external contacts to the fuse can slide.

In contrast to end contacts 15, 16, housing 17 is composed of an insulating material having sufficient impact strength to withstand the forces developed during a fusing operation. Housing 17 includes an outer tubular body 40 surrounding an inner tubular sleeve 41. The material employed for body 40 is preferably a moldable plastic compound such as glass filled polyester or glass filled epoxy. Sleeve 41 is composed of a synthetic fluorine containing resin such as "Teflon", and includes a bore 20 formed longitudinally therethrough for accepting a replaceable fuse assembly hereinafter to be described. As shown in FIG. 2, bore 20 and the central openings of end contacts 15 and 16 are in axial alignment when fuse 10 is assembled.

As shown in FIG. 2, the tubular assembly of fuse 10 includes a threaded connection between end contacts 15, 16 and housing 17. For convenience, only the structure of end contact 15 and its connection to body 40 of housing 17 will hereinafter be described it being understood that the structure of end contact 16 is identical thereto with corresponding elements being indicated with corresponding primed numerals. End contact 15 includes a central opening 18 having a first portion 21 having internal threads 22 formed in the end contact 15 for threadedly engaging external threads 23 formed on the end of body 40 of housing 17. Opening 18 further includes a second portion 24 of a reduced diameter which is less than the diameter of portion 21. First portion 21 and second portion 24 define an annular radially extending abutment surface 25 therebetween that engages the end of housing 17 when end contact 15 is threaded thereon so that contact 15 may be securely tightened on the end of housing 17. The inner surface of portion 24 is smooth and its diameter is sized to snugly receive the replaceable fuse assembly hereinafter to be described.

Opening 18 of the end contact 15 also includes a third portion 26 having a diameter greater than that of second portion 24. Third portion 26 has internal threads 27 formed in end contact 15 for threadedly engaging external threads 28 on the end of a clamping nut 29, the purpose of which will hereinafter be described. A tapered annular surface 30 extends in a diverging manner from second portion 24 to third portion 26. Surface 30 is formed at an angle which substantially corresponds to the angle of the contact ferrules of the replaceable fuse assembly so that adequate electrical contact is made between end contact 15 and the fuse assembly.

Clamping nut 29 includes a first bore 31 formed longitudinally therethrough which is coaxial with openings 18, 19 and bore 20 when nut 29 is assembled or threaded on end contact 15. Nut 29 also includes a second bore 32 extending transversely to bore 31 at its outer end. Bores 31 and 32 communicate with the outer surface of nut 29 so as to permit the fusing operation to occur in a conventional manner. Nut 29 also includes a cone shaped inner end 33 the purpose of which will hereinafter be described.

Referring to FIGS. 2 and 3, a replaceable fuse assembly is located in bore 20 of sleeve 41 of housing 17. The fuse assembly includes an explusion fuse link 34 which will begin fusing according to a predetermined fuse melt characteristic. Link 34 is installed in a fuse support tube or liner 35 which is composed of an insulating material such as a synthetic fluorine-containing resin like "Teflon", hornfiber, or other arc ablative material having both good dielectric and interrupting characteristics. Fuse link contact ferrules 36, 37 are installed on the ends of tube 35 to connect fuse link 34 to end contacts 15, 16 respectively. Fuse link 34 is electrically connected to contact ferrules 36, 37 usually by a solder joint. Fuse tube 35 serves several functions. First, it holds and protects fuse link 34 from damage due to handling. Second, it provides a non-conductive insulating bore that gives off arc extinguishing gas during the fusing operation. Tube 35 also absorbs much of the shock wave and pressure produced when fuse link 35 explodes and burns back during fusing, and transmits a more uniform force to the sleeve 41 and body 40 of housing 17. A major function of fuse tube 35 is to admit, trap, and contain some of the high energy products from the fusing of link 35. These products consist of molden fuse link bits, solids and gases caused by the vaporization of link 34 and insulating oil 14 in the fuse tube bore.

As shown in FIG. 2, contact ferrule 36 includes a tubular portion mounted within support tube 35 to which fuse link 34 is soldered and a cone shaped outer end extending from the end of tube 35. The angle of the cone shaped portion of ferrule 36 is substantially identical to the angle of tapered surface 30 so that the threaded end 38 of current limiting fuse 11 forces ferrule 36 into abutting relationship with tapered surface 30' to provide adequate electrical contact therebetween.

In contrast to ferrule 36, FIG. 4 illustrates that ferrule 37, although including a cylindrical portion secured to the inside of support tube 35, includes a plurality of deformable fingers 39 extending from tube 35 instead of the solid cone shaped portion of ferrule 36. As shown, there are six fingers 39 extending from tube 35. However, it is readily apparent that any number of fingers 39 could be utilized so long as adequate electrical contact is made between ferrule 37 and end contact 15. Fingers 39 are movable between a first position, as shown in FIG. 4 wherein they extend substantially co-axially from tube 35 so that tube 35 may be slidably received within bore 20 of housing 17, and a second deformed position shown in FIG. 2 extending in a direction transverse to the axis of tube 35 wherein fingers 39 are in electrical contact with end contact 15. Clamping nut 29 acts as a clamping means receivable within third portion 26 of opening 18 for moving fingers 39 from their first position to their second position. More specifically, the cone shaped inner end 33 of nut 29 converges to a point having a diameter which is less than the diameter of the outer ends of fingers 39 so that as nut 29 is turned into third portion 26 the cone shaped inner end 33 engages and spreads fingers 39 into engagement with tapered surface 30 and end contact 15.

A modular, screw together, expulsion fuse cartridge design has been illustrated and described to provide easy assembly and disassembly. To assemble the cartridge, end contact 16 is threaded onto the end of housing 17, and thereafter the fuse link assembly is slidably inserted into bore 20 of housing 17 with fingers 39 of ferrule 37 at the leading end until ferrule 36 engages tapered surface 30 of end contact 16. End contact 15 is then threaded onto the opposite of housing 17 and clamping nut 29 is then turned down into third portion 26 thereof until its cone shaped inner end 33 engages and spreads fingers 39 against contact 15. The assembly may then be attached to the end 38 of a current limiting fuse 11. To disassemble the cartridge the reverse procedure is performed.

Various modes of carrying out the invention are contemplated as being within the scope of the following claims particularly pointing out and distinctly claiming the subject matter which is regarded as the invention.

I claim:

1. A modular under oil expulsion fuse cartridge assembly releasably connected to a holder assembly having holder contacts, comprising:

a tubular housing of non-electrical conductive material having a bore extending longitudinally therethrough;

an electrically conductive contact removably mounted on each end of said housing, said end contacts having a diameter greater than the diameter of said housing and having axially inner and outer ends;

ramp means at the inner end of each of said end contacts, said ramp means having a surface extending angularly outwardly relative to said housing toward said end contacts and engageable by holder contacts to ease insertion and removal from a holder assembly; and a replaceable fuse assembly removably received within the bore of said housing, said fuse assembly including a fuse support tube and a fuse link supported within said tube electrically connected to each of said end contacts.

2. The assembly of claim 1, wherein said end contacts are removably threadedly mounted on each end of said housing.

3. The assembly of claim 1, wherein said ramp means has an inclination of between about 20° to about 45°.

4. The assembly of claim 3, wherein said ramp means is integral with said end contacts.

5. A modular under oil expulsion fuse cartridge assembly, comprising;

a tubular housing of non-electrical conductive material having a bore extending longitudinally therethrough;

an electrically conductive contact removably mounted on each end of said housing, each end contact includes a cylindrical body of electrically conductive material having a longitudinal opening extending therethrough, said opening including a first portion having internal threads therein for threadedly engaging external threads on the end of said housing, a second portion of reduced diameter that engages one of the electrical connections of said fuse link, and a third portion having a diameter greater than said second portion; and a replaceable fuse assembly removably received within the bore of said housing, said fuse assembly including a fuse support tube and a fuse link supported within said tube electrically connected to each of said end contacts.

6. The assembly of claim 5, wherein at least one of the electrical connections of said fuse link includes a plurality of deformable fingers movable between a first position extending substantially coaxially from said fuse support tube wherein said fuse assembly may be slidably received within said housing bore, and a second deformed position extending in a direction transverse to the axis of said fuse support tube wherein said fingers are in electrical contact with said end contact.

7. The assembly of claim 6, further including clamping means receivable within the third portion of said opening for moving said fingers from said first position to said second position.

8. The assembly of claim 7, wherein said clamping means comprises a clamping nut threadedly engageable within said third portion.

9. The assembly of claim 8, wherein said clamping nut includes a cone-shaped inner end so that as said nut is turned into said third portion said cone-shaped inner end engages and spreads said fingers into engagement with said end contact.

10. The assembly of claim 5, wherein said first and second portions define an abutment surface therebetween that engages the end of said housing when said end contact is threaded thereon.

* * * * *